US010500851B2

(12) United States Patent
Osuki et al.

(10) Patent No.: US 10,500,851 B2
(45) Date of Patent: Dec. 10, 2019

(54) PRINT ELEMENT SUBSTRATE, PRINTHEAD, AND PRINTING APPARATUS

(71) Applicant: CANON KABUSHIKI KAISHA, Tokyo (JP)

(72) Inventors: Yohei Osuki, Nagareyama (JP); Koichi Omata, Kawasaki (JP); Hideo Tamura, Kawasaki (JP); Takaaki Yamaguchi, Yokohama (JP); Kousuke Kubo, Kawasaki (JP); Ryoji Oohashi, Yokohama (JP); Yuji Tamaru, Yokohama (JP); Toshio Negishi, Yokohama (JP); Suguru Taniguchi, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/692,105

(22) Filed: Aug. 31, 2017

(65) Prior Publication Data

US 2018/0104954 A1 Apr. 19, 2018

(30) Foreign Application Priority Data

Oct. 18, 2016 (JP) ..... 2016-204566

(51) Int. Cl.
*B41J 2/14* (2006.01)

(52) U.S. Cl.
CPC ..... *B41J 2/14072* (2013.01); *B41J 2/14088* (2013.01)

(58) Field of Classification Search
None
See application file for complete search history.

(56) References Cited

U.S. PATENT DOCUMENTS

| | | | | |
|---|---|---|---|---|
| 6,997,546 | B2 | 2/2006 | Imanaka et al. | |
| 7,267,430 | B2 | 9/2007 | Parish | |
| 8,523,329 | B2 | 9/2013 | Tamaru et al. | |
| 2005/0168534 | A1* | 8/2005 | Beak | B41J 2/14072 347/59 |
| 2009/0135229 | A1* | 5/2009 | Kurokawa | B41J 2/04541 347/59 |
| 2011/0210997 | A1* | 9/2011 | Tamaru | B41J 2/14129 347/9 |
| 2013/0093808 | A1* | 4/2013 | Kanno | B41J 2/04508 347/9 |
| 2013/0241986 | A1* | 9/2013 | Aoki | B41J 2/11 347/10 |

* cited by examiner

*Primary Examiner* — Erica S Lin
(74) *Attorney, Agent, or Firm* — Venable LLP

(57) ABSTRACT

A print element substrate, comprises: a heater layer; a wiring layer that is connected to the heater layer and is for causing the heater layer to generate heat; an insulating layer arranged on the wiring layer; an anti-cavitation layer arranged on the insulating layer that is for protecting the insulating layer; and a switch that has a control terminal that is pulled-down to a ground, and causes the anti-cavitation layer and the ground to have an electrical connection when the control terminal is in a high-level state.

16 Claims, 12 Drawing Sheets

PRINT ELEMENT SUBSTRATE, PRINTHEAD, AND PRINTING APPARATUS

BACKGROUND OF THE INVENTION

Field of the Invention

The present invention relates to a print element substrate, a printhead, and a printing apparatus.

Description of the Related Art

Conventionally, there are printing apparatuses that perform printing by causing droplets discharged from a liquid discharge head (a printhead) to land on a printing medium. There are various methods for liquid discharge by a liquid discharge head, and a thermal ink-jet method is known as one of them. The thermal ink-jet method is a method that uses, in discharge of ink droplets, an ink bubbling phenomenon induced by thermal energy that occurs by energizing a heater for approximately several μs. A liquid discharge head used in the thermal ink-jet method is typically equipped with a print element substrate. The print element substrate has a heater necessary for ink droplet discharge.

It is known that a print element substrate malfunction caused by electro-static discharge (hereinafter expressed as ESD) occurs in a manufacturing process of a print element substrate, a printing operation by a liquid discharge head, or the like. The specification of U.S. Pat. No. 7,267,430 recites a phenomenon of insulation breakdown due to ESD (hereinafter, ESD breakdown) occurring for a protection film between an anti-cavitation layer and a heater electrode in a print element substrate for which a thickness of the protection film is approximately 200 nm. With respect to the above problem, the specification of U.S. Pat. No. 7,267,430 discloses a print element substrate in which an anti-cavitation layer is connected to a gate-grounded MOS (Metal-Oxide-Semiconductor) transistor. By the configuration of the specification of U.S. Pat. No. 7,267,430, because it is possible to release, into the substrate, a current due to ESD that has flowed into the anti-cavitation layer, an effect of being able to prevent insulation breakdown of a protection film between the anti-cavitation layer and the heater electrode is recited.

For a print element substrate, to confirm the existence or absence of defects that occur due to ESD or defects due to a film defect in a manufacturing process stage, inspection of electrical characteristics of the print element substrate is performed in the final stage of the manufacturing process of the print element substrate. As one type of inspection, there is an inspection that confirms whether there is no electrical connection between an anti-cavitation layer and a wiring layer. One reason why this inspection is necessary is that, when a defect such as a pinhole is present in an insulating layer, a current flows between an anti-cavitation layer and a wiring layer, and a desired heat generation characteristic cannot be achieved at a time of a printing operation. Another reason is that an anti-cavitation layer changes in nature due to an electrochemical reaction occurring, and durability decreases. An electrical connection inspection at this point between the anti-cavitation layer and the wiring layer needs to confirm various characteristics by changing methods of applying voltages. This is because the electrical connection inspection between the anti-cavitation layer and the wiring layer gives results that include characteristics of a semiconductor element in accordance with a location where a defect is present.

However, for example, in a state where an anti-cavitation layer is connected to GND via an ESD protection element disclosed in the specification of U.S. Pat. No. 7,267,430, there is influence by characteristics of the protection element when an electrical connection inspection between the anti-cavitation layer and a wiring layer is performed, and it is not possible to accurately perform the electrical connection inspection. To accurately inspect a defect of the insulating layer in accordance with an electrical connection inspection, it is necessary to disconnect the anti-cavitation layer from GND. Furthermore, when the printhead performs printing, the heater layer may be short-circuited with the anti-cavitation layer of an upper layer. In that case, when a voltage for driving the heater is applied, a problem will occur in that current flows to GND via the anti-cavitation layer.

SUMMARY OF THE INVENTION

The present invention, in view of the aforementioned problem, provides a configuration that can perform an accurate electrical connection inspection of an anti-cavitation layer and a wiring layer, while increasing ESD resistance, in a print element substrate. Furthermore, even if the heater layer is short-circuited with the anti-cavitation layer, the preset invention can prevent a problem in which current flows to GND via the anti-cavitation layer.

According to one aspect of the present invention, there is provided a print element substrate, comprising: a heater layer; a wiring layer that is connected to the heater layer and is for causing the heater layer to generate heat; an insulating layer arranged on the wiring layer; an anti-cavitation layer arranged on the insulating layer that is for protecting the insulating layer; and a switch that has a control terminal that is pulled-down to a ground, and causes the anti-cavitation layer and the ground to have an electrical connection when the control terminal is in a high-level state.

According to another aspect of the present invention, there is provided a printhead, comprising: one or more print element substrates; and a print element substrate, comprising: a heater layer; a wiring layer that is connected to the heater layer and is for causing the heater layer to generate heat; an insulating layer arranged on the wiring layer; an anti-cavitation layer arranged on the insulating layer that is for protecting the insulating layer; and a switch that has a control terminal that is pulled-down to a ground, and causes the anti-cavitation layer and the ground to have an electrical connection when the control terminal is in a high-level state.

According to another aspect of the present invention, there is provided a printing apparatus, comprising: one or more print element substrates; and a print element substrate, comprising: a heater layer; a wiring layer that is connected to the heater layer and is for causing the heater layer to generate heat; an insulating layer arranged on the wiring layer; an anti-caviatation layer arranged on the insulating layer that is for protecting the insulating layer; and a switch that has a control terminal that is pulled-down to a ground, and causes the anti-cavitation layer and the ground to have an electrical connection when the control terminal is in a high-level state.

By the present application invention, it is possible to perform an accurate electrical connection confirmation of an anti-cavitation layer and a wiring layer, while increasing ESD resistance, in a print element substrate.

Further features of the present invention will become apparent from the following description of exemplary embodiments (with reference to the attached drawings).

DESCRIPTION OF THE EMBODIMENTS

Figure 1:
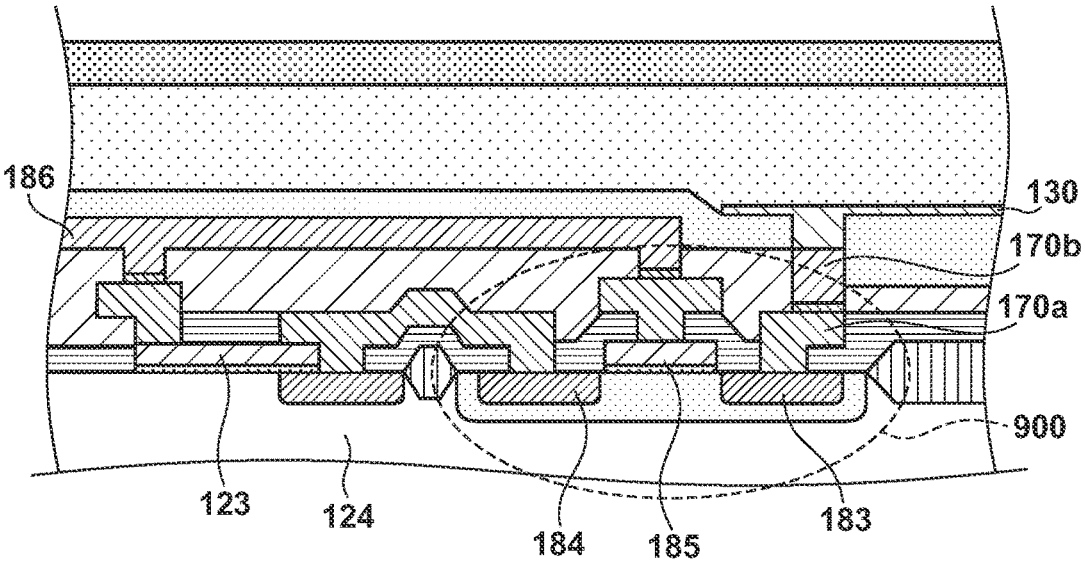
FIG. 1 is an expanded cross-sectional view of a print element substrate according to the present application invention.

Explanation is given below regarding embodiments of the present invention with reference to the attached drawings. Note that the following embodiments do not limit the present invention in regard to the scope of the patent claims, and, in addition, there is no limitation to all combinations of the features explained in the embodiments being necessary in the constructions for solving the present invention. Note that the same reference numerals have been added to the same configuration elements, and explanation thereof is omitted.

Note that in this specification, "print" encompasses forming not only meaningful information such as characters and shapes, but also meaningless information. Furthermore, "print" broadly encompasses cases in which an image or pattern is formed on a printing medium irrespective of whether or not it is something that a person can visually perceive, and cases in which a medium is processed.

Also, "printing medium" broadly encompasses not only paper used in a typical printing apparatus, but also things that can receive ink such as cloths, plastic films, metal plates, glass, ceramics, wood materials, hides or the like.

Furthermore, similarly to the foregoing definition of "print", "ink" (also referred to as "liquid") should be broadly interpreted. Accordingly, "ink" encompasses liquids that by being applied to a printing medium can be supplied in the forming of images, patterns or the like, processing of printing mediums, or processing of ink (for example, insolubilization or freezing of a colorant in ink applied to a printing medium).

Furthermore, "print element", unless specified otherwise, encompasses an orifice and an element that produces energy that is used for discharge of ink and a fluid channel that communicates therewith collectively.

Furthermore, "nozzle", unless specified otherwise, encompasses an orifice and an element that produces energy that is used for discharge of ink and a fluid channel that communicates therewith collectively.

An element substrate for a printhead (a head substrate) used below does not indicate a mere substrate consisting of a silicon semiconductor but rather indicates a configuration in which elements, wiring, and the like are disposed.

Furthermore, "on the substrate" means not only simply on top of the element substrate, but also the surface of the element substrate, and the inside of the element substrate in the vicinity of the surface. Also, "built-in" in the present invention does not mean that separate elements are simply arranged as separate bodies on a substrate surface, but rather means that the elements are formed and manufactured integrally on the element board by a semiconductor circuit manufacturing process.

Accordingly, a liquid discharge head according to the present invention is used not only in a serial type printing apparatus that is commonly found, but also in a printing apparatus comprising a full-line type printhead whose print width corresponds to the width of the printing medium. Also, the printhead is used in large format printers that use printing mediums of a large size such as AO and BO in serial type printing apparatuses.

Explanation is given regarding an example of a configuration of a printing apparatus to which the present application invention can be applied.

[Apparatus Configuration]

Figure 7:
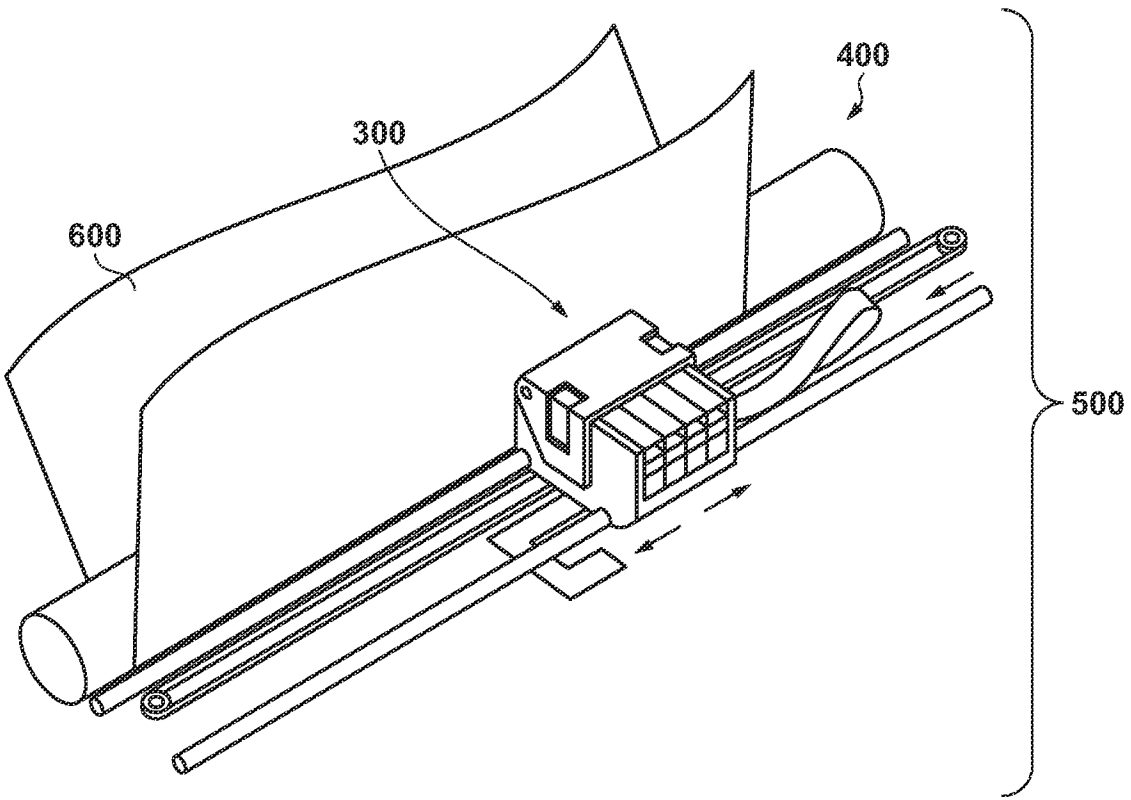
FIG. 7 is a view for illustrating an example configuration of a printing apparatus.

FIG. 7 is a perspective view that illustrates an example of a printing apparatus that uses a liquid discharge method to which the present application invention can be applied (hereinafter may be referred to simply as a printing apparatus). A printing apparatus 500 is provided with a liquid discharge head (hereinafter, printhead) 300 and a printing medium sending mechanism 400. The printhead 300 scans above a printing medium 600 that is, for example, paper set in the printing medium sending mechanism 400. During scanning the printhead 300 discharges ink droplets, and causes them to land on desired positions on the printing medium 600 to thereby perform printing. After the end of scanning by the printhead 300, the printing medium 600 is sent in a direction that is orthogonal to the scanning direction of the printhead by the printing medium sending mechanism 400. By repeating the operation explained above, printing to the printing medium completes.

Figure 8:
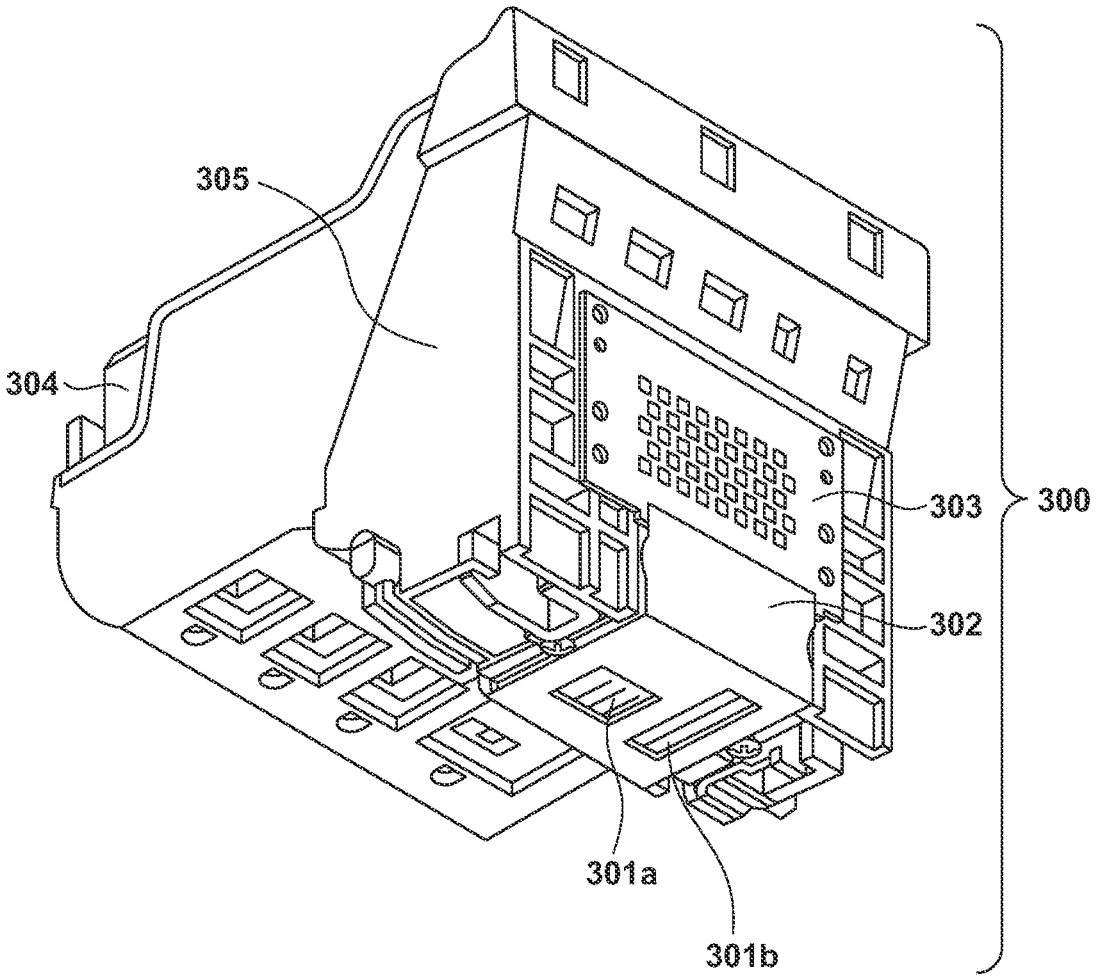
FIG. 8 is a view for illustrating an example configuration of a printhead.

FIG. 8 is a perspective view that illustrates an example of the printhead 300 according to the present application invention. A housing 305 is equipped with a wiring member 302, a wiring substrate 303, and print element substrates 301. In addition, one or a plurality of an ink tank 304 corresponding to respective colors are mounted in the housing 305. The ink stored in the ink tank 304 is introduced to the print element substrates 301 through the printhead 300.

Figure 9:
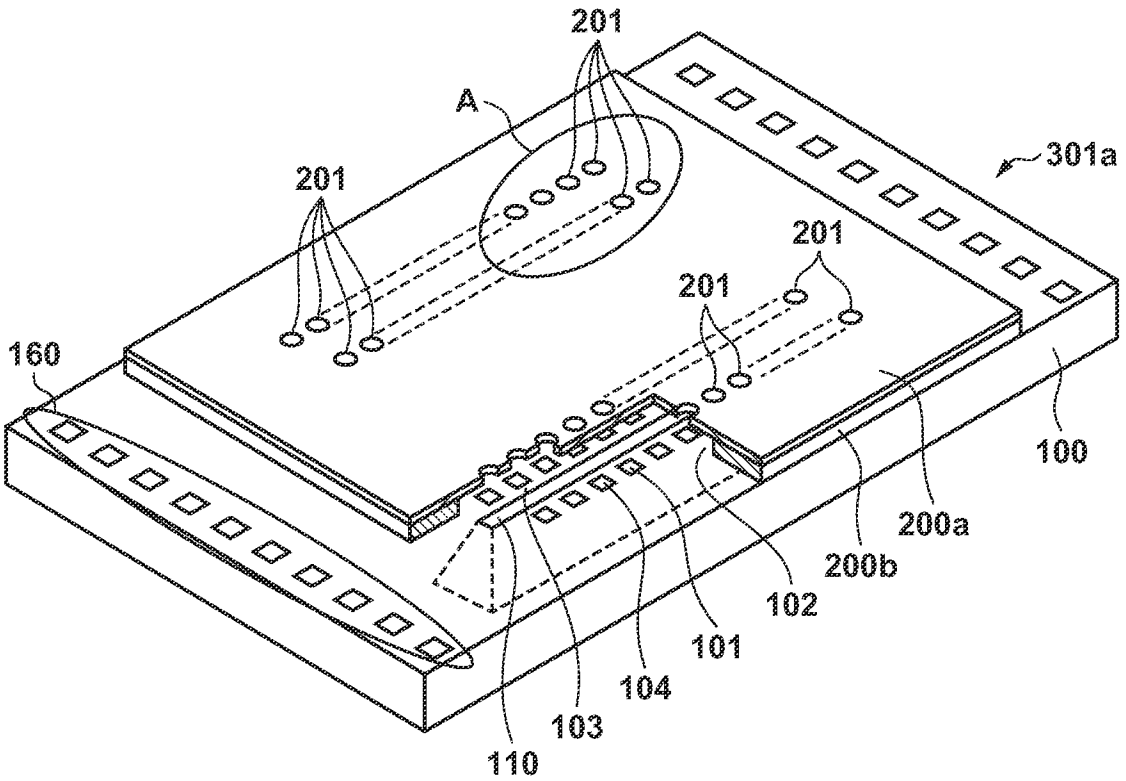
FIG. 9 is a view for illustrating an example configuration of a print element substrate.

FIG. 9 is a perspective view that illustrates an example of one of the print element substrates 301 that is equipped in the printhead 300 according to the present embodiment. A heater 101 is arranged on a substrate 100 in the print element substrate 301. A supply port 110 is formed in the substrate 100. Additionally, a channel formation member 200*b* and an orifice formation member 200*a* are provided on the substrate 100. The channel formation member 200*b* forms a bubbling chamber 102 that corresponds to the heater 101, a liquid chamber 104 for guiding ink from the supply port 110 to the bubbling chamber 102, and a channel 103. The orifice formation member 200*a* forms an orifice 201 that corresponds to the heater 101. In addition, an external connection pad 160 for supplying a signal or a voltage from outside to the substrate 100 is provided on the substrate 100. A logic signal of a high level (for example, 3.3 volts) or a low level (for example, 0 volts) is inputted to the pad 160.

Figure 10A:
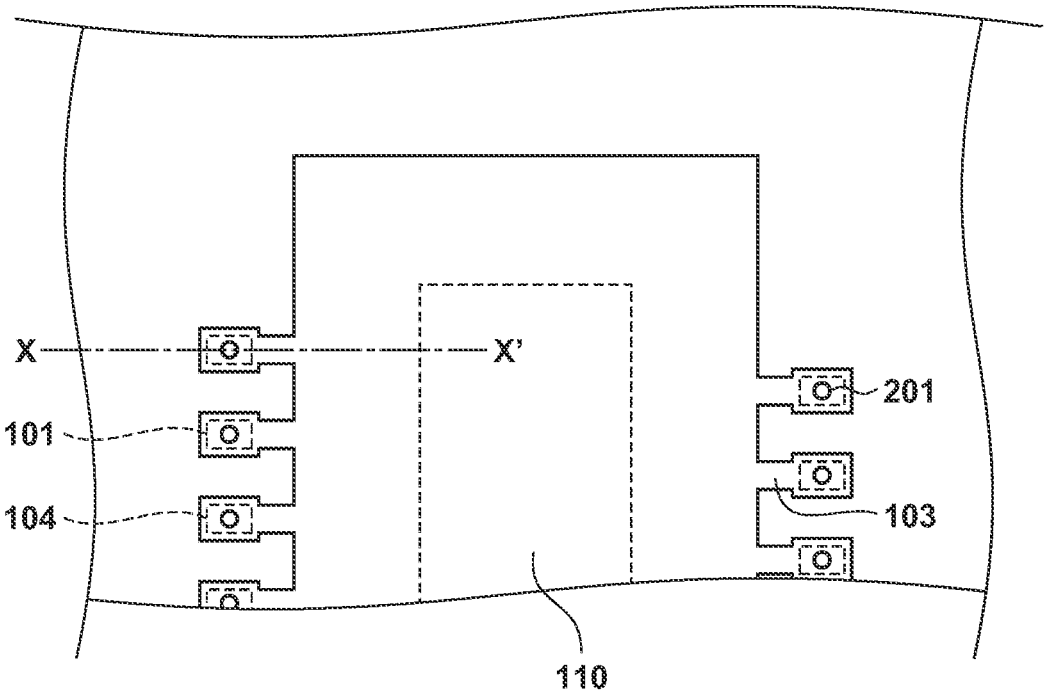
FIGS. 10A and 10B are expanded plan views of a print element substrate.
Figure 10B:
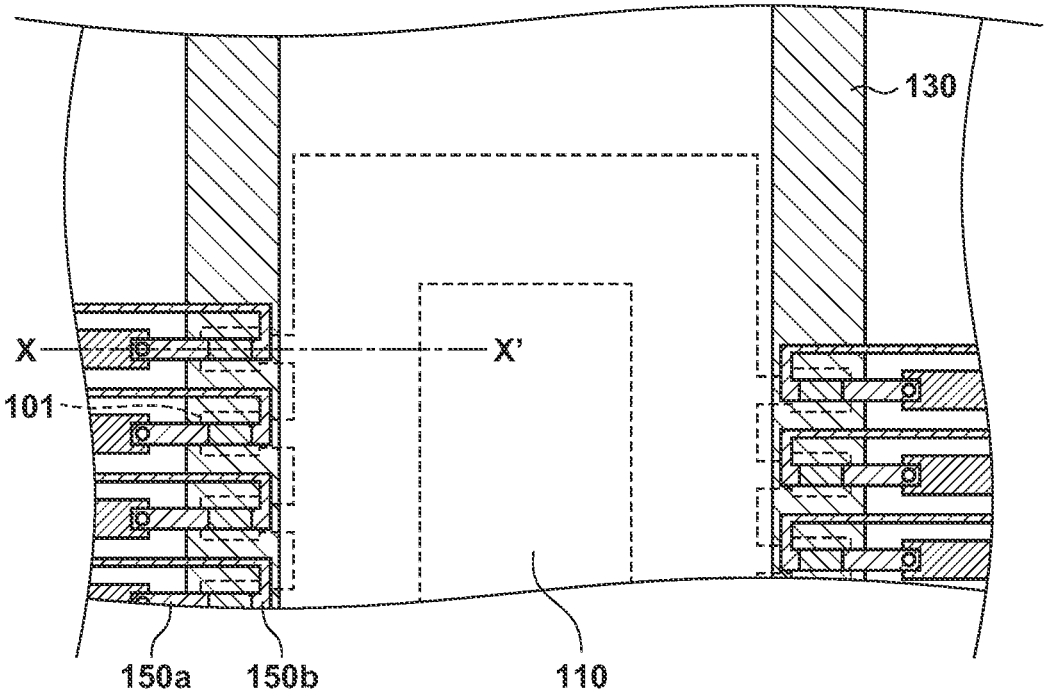

FIG. 10A is a plan view that expands and illustrates a region A of FIG. 9. FIG. 10B is a perspective view in which the channel formation member 200*b* and the orifice formation member 200*a* in FIG. 10A are illustrated by dashed lines. A shared heater electrode 150*a* and a discrete heater electrode 150*b* are electrically connected to the heater 101. The discrete heater electrode 150*b* is connected to a switching element at a terminal that is separate from a side that is connected to the heater 101. In other words, the shared heater electrode 150*a* and the discrete heater electrode 150*b* configure a wiring layer. An anti-cavitation layer 130 is arranged on the heater 101. An anti-cavitation layer may be referred to as a protection layer for protecting the heater from ink bubbles, heat when bubbles disappear, as well as from physical and chemical impact.

Figure 11:
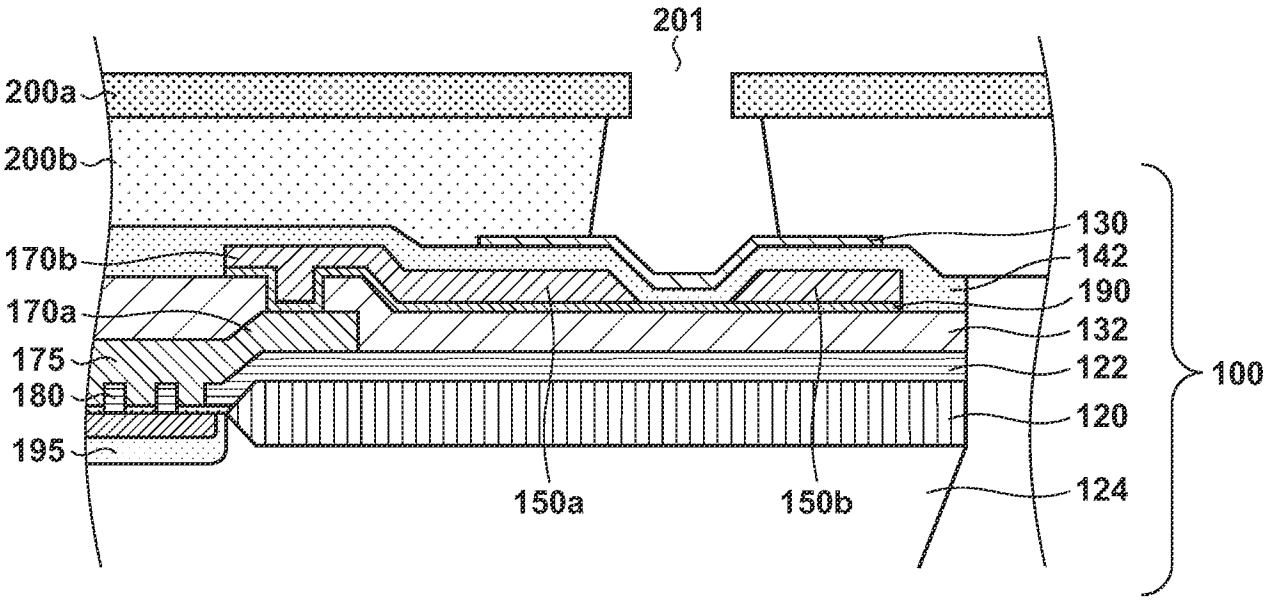
FIG. 11 is a cross-sectional view of a print element substrate.

FIG. 11 is a cross-sectional view that illustrates a cross section that follows X-X' of FIG. 10A and FIG. 10B. The substrate 100 is configured by a plurality of layers as discussed below. A thermal oxide film 120 and a gate oxide film (not shown) are formed on an Si substrate 124. A first heat storage layer 122 is formed on the thermal oxide film 120. A first switching element electrode 175 is formed on the first heat storage layer 122. The first switching element electrode 175 is connected to the Si substrate 124 through a via 180 provided in the first heat storage layer 122. An impurity diffusion region 195 is formed at a connection region for the Si substrate 124 and the first switching element electrode 175. A switching element (corresponds to a driving circuit 105 of FIG. 2) is formed by the first switching element electrode 175, the impurity diffusion region 195, the Si substrate 124, a second switching element (not shown) and a gate electrode (not shown).

A second heat storage layer 132 is formed on the first switching element electrode 175. A heater layer 190 is formed on the second heat storage layer 132. A shared heater electrode 150*a* and a discrete heater electrode 150*b* are formed on the heater layer 190, and these form a wiring layer. The heater layer 190 formed between the shared heater electrode 150*a* and the discrete heater electrode 150*b* forms the heater 101. By the heater 101 generating heat, a liquid such as ink heats up and is caused to be discharged from the orifice. A protection layer 142 as an insulating layer is formed on the shared heater electrode 150*a*, the discrete heater electrode 150*b*, and the heater 101. The anti-cavitation layer 130 is formed on the protection layer 142. A channel formation member 200*b* is formed on the anti-cavitation layer 130. An orifice formation member 200*a* is formed on the channel formation member 200*b*. By the channel formation member 200*b* and the orifice formation member 200*a*, the bubbling chamber 102, the liquid chamber 104, and the channel 103 are formed. In addition, the orifice 201 is formed by the orifice formation member 200*a*. Here, for convenience, the channel formation member 200*b* and the orifice formation member 200*a* may be collectively referred to as a formation layer.

[Manufacturing Process Flow]

Figure 12:
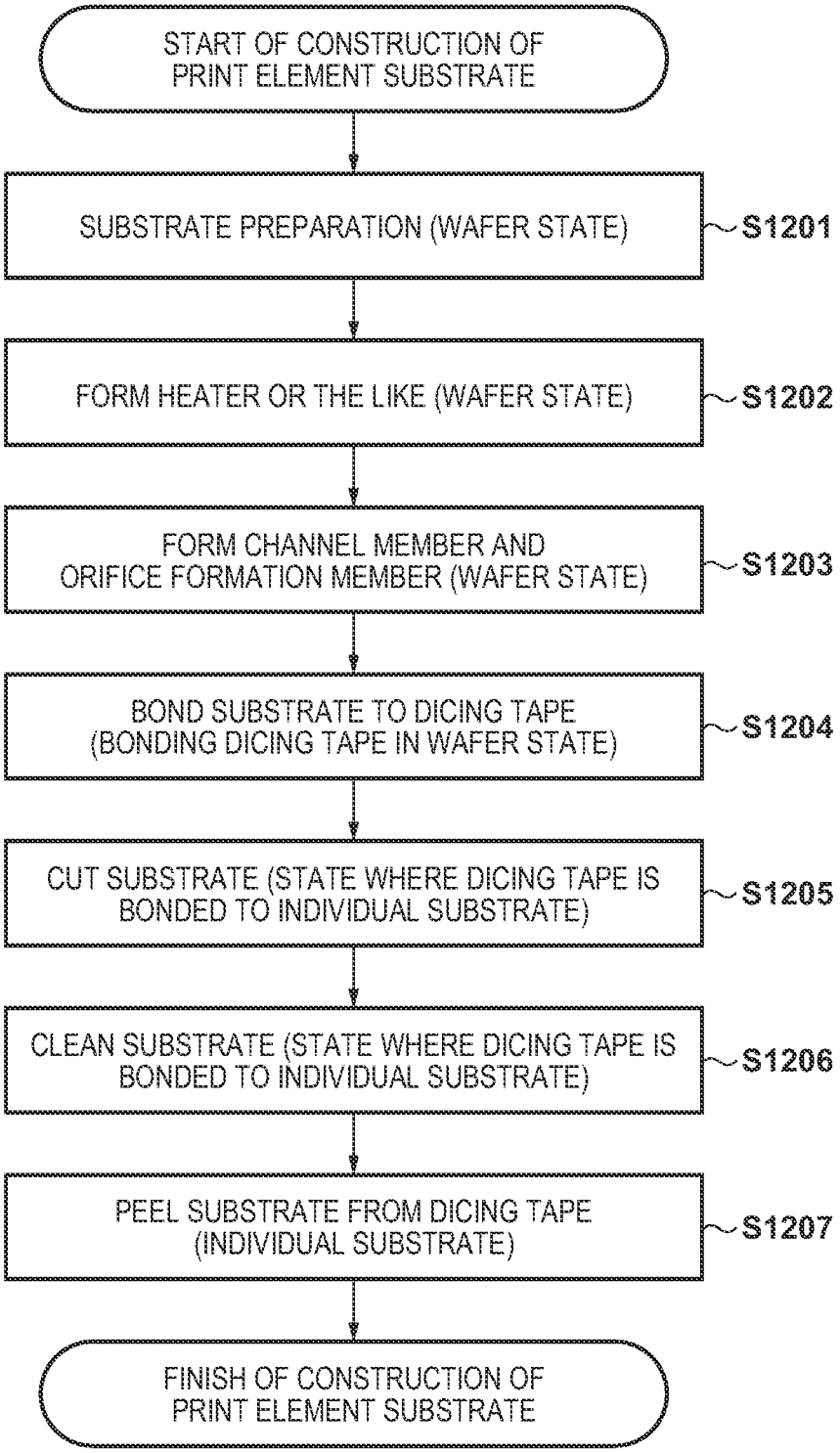
FIG. 12 is a manufacturing step process flow of a print element substrate.

FIG. 12 is a process flow that illustrates an example of a process for manufacturing the print element substrate 301. Note that the process flow illustrated here is one example, and only an overview is illustrated here.

In step S1201, preparation of a substrate for manufacturing the print element substrate 301 is performed.

In step S1202, a heater or the like is formed on a prepared wafer-state substrate by using depositing such as by a thermal oxidation method, a CVD method, or a sputtering method, patterning such as by a photolithography technique, impurity addition such as by thermal diffusion or an ion implantation technique, or the like.

In step S1203, a channel member and an orifice formation member are formed by, for example, bonding a dry film to the wafer-state substrate after the formation in step S1202, and using resist coating.

In step S1204, the wafer-state substrate after the formation of step S1203 is bonded to dicing tape.

Figure 13:
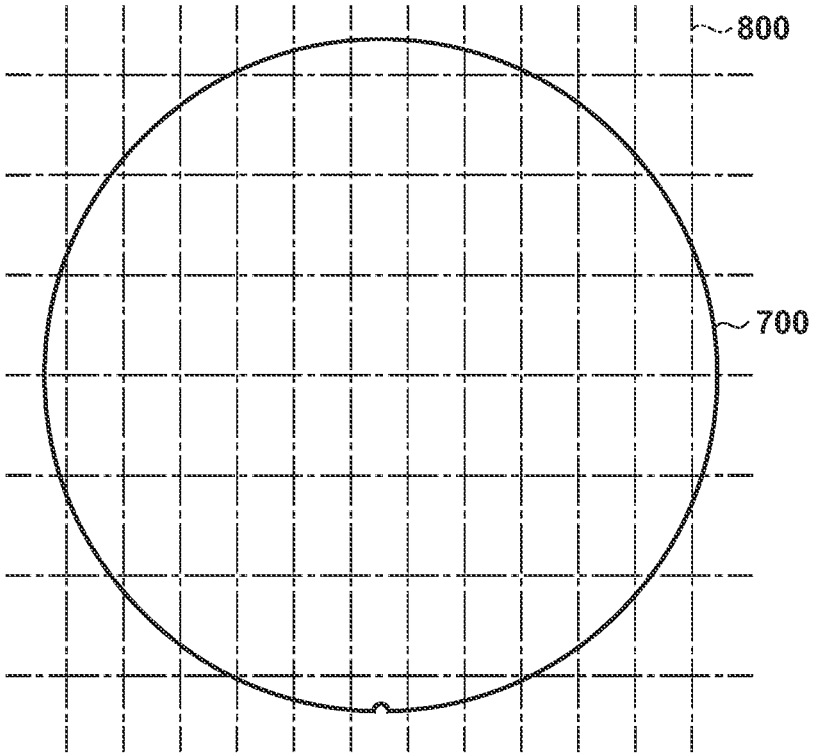
FIG. 13 is a view for illustrating an example of cutting a wafer in a manufacturing process of a print element substrate.

In step S1205, the wafer-state substrate is cut by a diamond saw or the like. FIG. 13 illustrates an example of cutting lines 800 and a wafer 700 before cutting.

In step S1206, the print element substrate 301 which has been cut into a separate substrate state is cleaned to remove cut scrap which is left bonded to the dicing tape. In this cleaning, cleaning by two fluids that uses a cleaning agent that combines water and nitrogen is used, for example.

In step S1207, the cleaned print element substrate 301 is peeled away from the dicing tape and installed into a printhead.

Explanation is given below regarding each embodiment according to the present application invention.

First Embodiment

Explanation is given regarding the print element substrate 301 that is installed in the printhead 300 according to the present application invention. FIG. 1 is a view that illustrates a portion of a cross section of the print element substrate 301. FIG. 1 illustrates a cross section of a position different to the X-X' direction illustrated in FIG. 10A, and for example may be a cross-section of a direction orthogonal to the X-X' direction.

Figure 2:
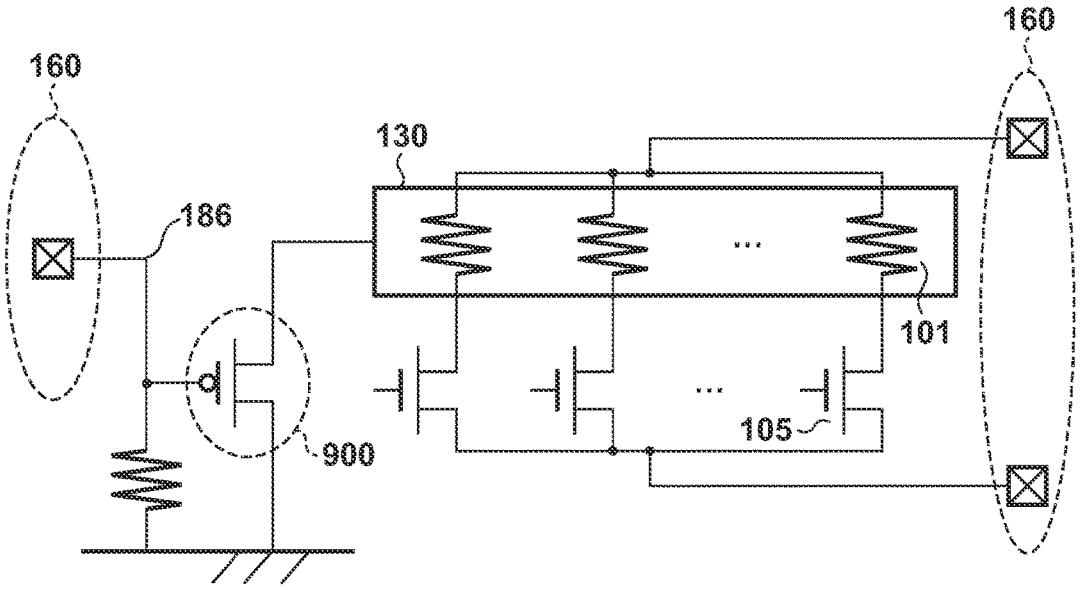
FIG. 2 is a schematic view of an example of a circuit configuration of the print element substrate according to the present application invention.

FIG. 2 is a view that illustrates an overview of a circuit configuration that corresponds to FIG. 1. In FIG. 2, for each of a plurality of the heater 101, one end is connected to an external connection pad 160 that is connected to a power supply (not shown) for example, and the other end is connected to a corresponding driving circuit 105. In addition, the plurality of the driving circuit 105, which is illustrated as an nMOS transistor, have their drain connected to a corresponding heater 101, and their source is connected to an external connection pad 160 that is connected to a ground voltage for example.

The anti-cavitation layer 130 is the same layer as the anti-cavitation layer 130 illustrated in FIG. 11, and is also in an electrically connected state. The anti-cavitation layer 130 can be formed at approximately 100 nm to 300 nm by Ta or Ir, for example. The anti-cavitation layer 130 is connected to a pMOS transistor 900 that functions as a switch. The anti-cavitation layer 130 is connected with a drain 183 of the pMOS transistor 900 via drain wiring 170*a* and 170*b*. A source 184 of the pMOS transistor 900 is connected to a ground (the Si substrate 124). Wiring for connecting the anti-cavitation layer 130 to the pMOS transistor 900 may be formed by using a wiring layer.

In a state where a low-level signal is inputted to the gate 185 of the pMOS transistor 900 (a conductive state between drain-source), the anti-cavitation layer 130 enters a state of being electrically connected to the Si substrate 124. Even if ESD occurs and charge flows to the anti-cavitation layer 130 in this state, this is a configuration in which charge is immediately released to the Si substrate 124.

In addition, the pad 160 is connected to the gate 185 of the pMOS transistor 900 via wiring 186. The gate of the pMOS transistor 900 is connected to the Si substrate 124 via a resistor formed by a Poly-Si layer 123. The wiring 186 is also connected to the resistor. Accordingly, the gate of the pMOS transistor 900 is pulled-down to ground by this resistor. Accordingly, a conductive state between drain-source is entered as long as a high-level signal is not sent from an external unit to the gate of the pMOS transistor 900 via the external connection pad 160. Therefore, a configuration is achieved in which even if ESD occurs in a state where a signal cannot be sent, such as in a stage of a process for manufacturing the print element substrate 301, the charge thereof is released to the Si substrate 124.

Figure 3A:
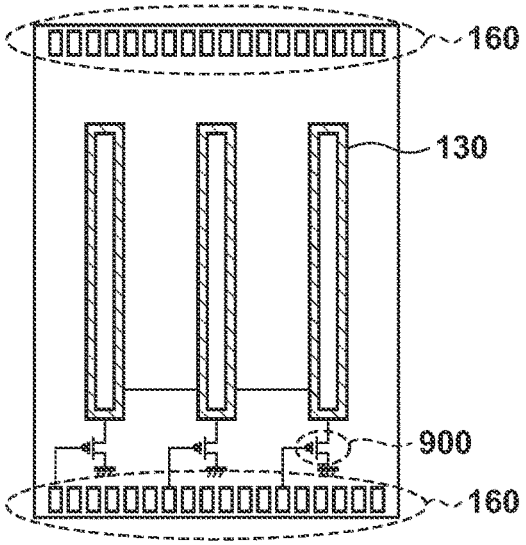
FIGS. 3A, 3B and 3C are views illustrating examples of configurations of the print element substrate according to the present application invention.

FIG. 3A is a view that illustrates a top surface of the entirety of the print element substrate 301, including the configuration illustrated in FIG. 1. In FIG. 3A, a pMOS transistor 900 is provided with respect to each anti-cavitation layer 130 that are provided so as to be respectively separated.

In a case of checking whether there is no electrical connection between a wiring layer and the anti-cavitation layer 130 in a state of a process for manufacturing the print element substrate 301, a high-level signal is sent to the external connection pad 160 that is connected to the gate of the pMOS transistor 900. By a high-level signal being inputted to the gate 185 of the pMOS transistor 900, a state of disconnection between drain-source of the pMOS transistor 900 is entered. Accordingly, even in a state having semiconductor characteristics in an electrical connection inspection between the anti-cavitation layer 130 and a wiring layer, it is possible to confirm various characteristics by changing methods of applying voltages, and an accurate electrical connection inspection of the anti-cavitation layer 130 and the wiring layer can be performed.

Second Embodiment

Figure 3B:
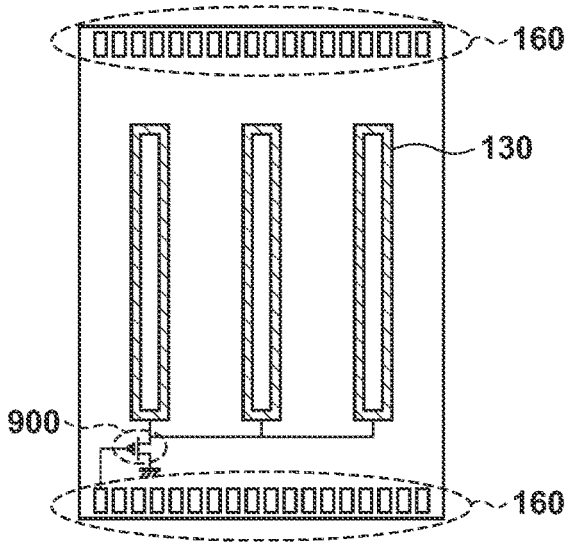

FIG. 3B illustrates a second embodiment according to the present application invention. A difference from the configuration of FIG. 3A illustrated in the first embodiment is that anti-cavitation layers 130 that are arranged so as to be separated are connected to the drain of one pMOS transistor 900.

By the configuration of according to the present embodiment, it is possible to reduce a region of the external connection pad 160 and a region for forming the pMOS transistor 900, in comparison with the configuration of FIG. 3A.

Third Embodiment

Figure 3C:
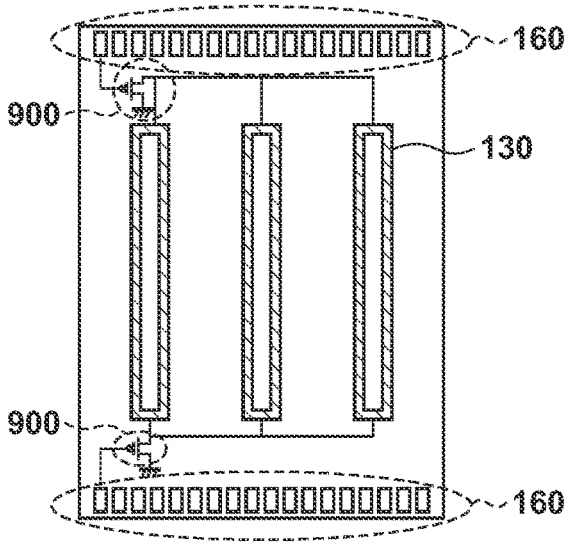

FIG. 3C illustrates a third embodiment according to the present application invention. A difference with the configuration of FIG. 3A illustrated in the first embodiment is that a pMOS transistor 900 is provided on both sides of the anti-cavitation layers 130. In other words, the print element substrate 301 is provided with external connection pads 160 that sandwich anti-cavitation layers 130 on both sides, and a pMOS transistor 900 is respectively provided between these and the anti-cavitation layers 130. In other words, one anti-cavitation layer 130 is connected to a plurality of the pMOS transistor 900.

By the configuration according to the present embodiment, it is possible to make a resistance value between GND and a central portion of the anti-cavitation layers 130 be comparatively low, even if the chip length of the print element substrate 301 and additionally the anti-cavitation layer 130 becomes longer. Accordingly, a configuration is achieved in which, if ESD occurs, it is easier for charge to escape to GND, regardless of where in the anti-cavitation layer 130 charge flows to.

Note that, in the configuration of FIG. 3C, illustration is given of an example in which two of the pMOS transistor 900 are connected to one (array of) the anti-cavitation layers 130. However, there is no limitation to this, and for example, three or more of the pMOS transistor 900 may be connected, in accordance with the size of the anti-cavitation layers 130.

Fourth Embodiment

Explanation is given below regarding a fourth embodiment according to the present application invention. For a print element substrate that is installed in a printhead, if usage is continued, a wire breakage may occur for a heater. Accordingly, explanation is given regarding a configuration that considers this problem.

Figure 6A:
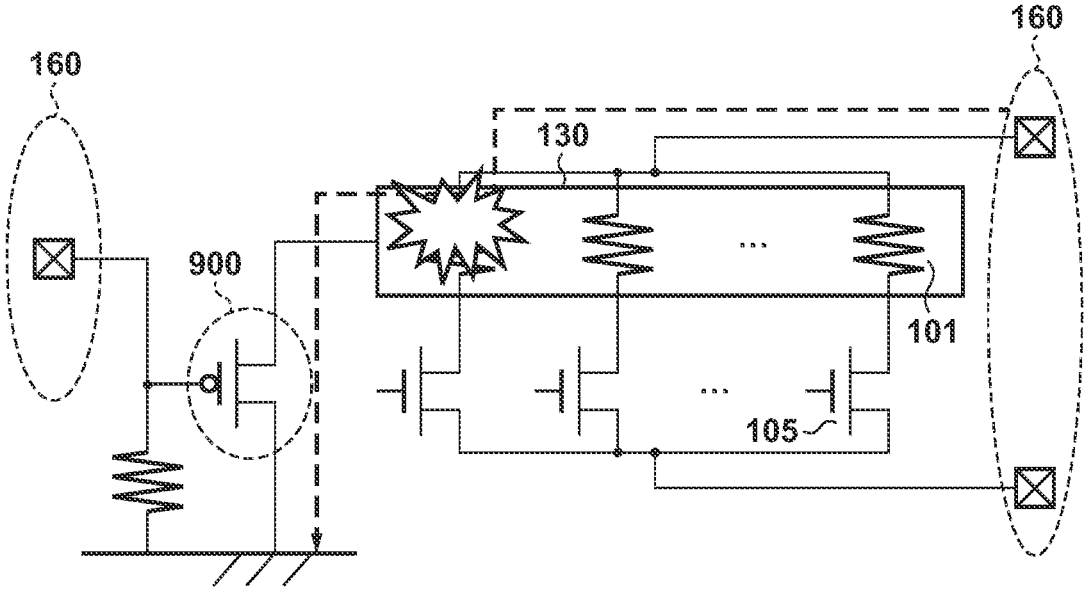
FIGS. 6A and 6B are views for explaining control at a time of a wire breakage for a heater according to a fourth embodiment.

FIG. 6A is a view for explaining a state in which a wire breakage for the heater 101 has occurred in the print element substrate 301. Here, the heater layer is short-circuited with the anti-cavitation layer 130 of an upper layer. In that case, when a voltage for driving the heater 101 is applied, a problem will occur in that current flows to GND to which the source of the pMOS transistor 900 is connected via the anti-cavitation layer 130.

Figure 6B:
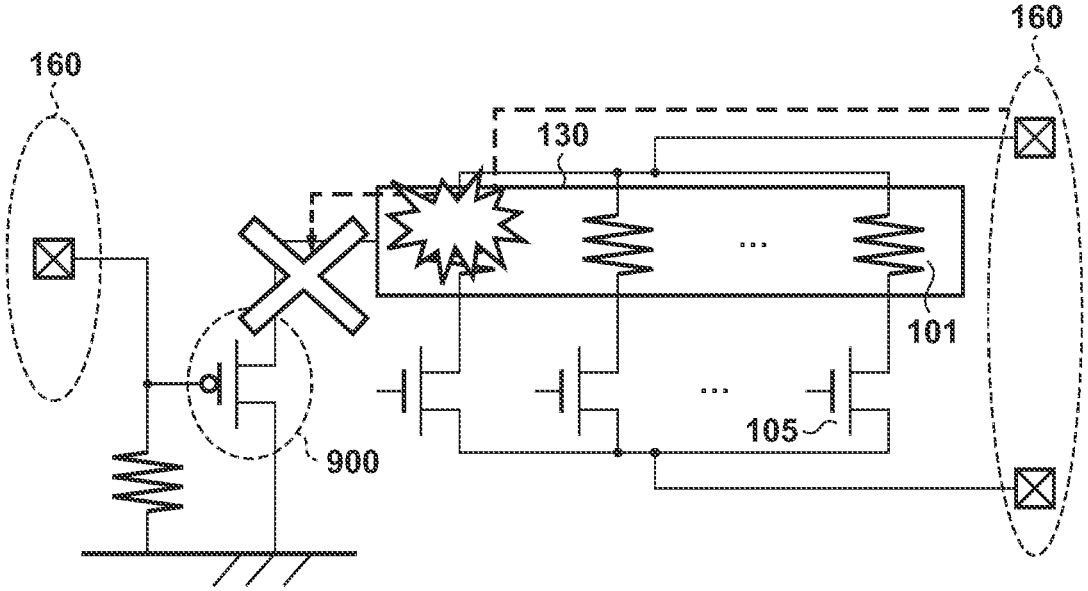

To have such a problem not occur, there is a need to disconnect GND and the anti-cavitation layer 130 when driving the heater 101. Accordingly, in the present embodiment, when driving the heater 101, as illustrated in FIG. 6B, the pMOS transistor 900 is set to an on state at all times (a disconnection state between drain-source), and control is performed so as to disconnect the anti-cavitation layer 130 and GND to which the source of the pMOS transistor 900 is connected. The control here, for example, can be realized by control by a controller (not shown) that the printing apparatus 500 is provided with that makes the pMOS transistor 900 enter the on state via the external connection pad 160.

By the control according to the present embodiment, even if the heater layer is short-circuited with the anti-cavitation layer 130 of an upper layer, it is possible to prevent a problem in which current flows to GND via the anti-cavitation layer 130, even if a voltage is applied.

Fifth Embodiment

Explanation is given below regarding a fifth embodiment according to the present application invention.

Figure 4A:
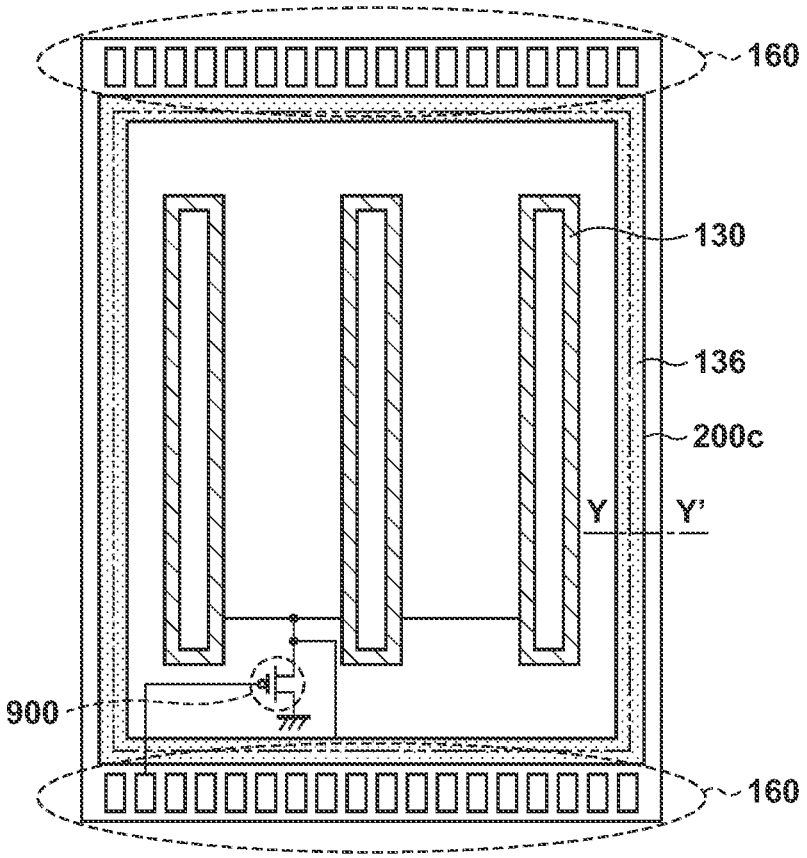
FIGS. 4A and 4B are views illustrating examples of configurations of the print element substrate according to a fifth embodiment.
Figure 4B:
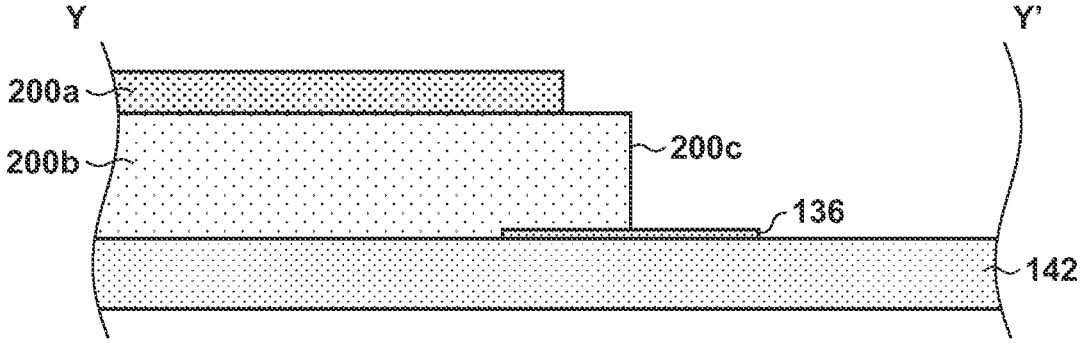

FIG. 4A is a view that illustrates an example of a configuration of the print element substrates 301 according to the present embodiment. FIG. 4B is a view that illustrates a cross section of Y-Y' of FIG. 4A. A metal layer 136 is formed below the channel formation member 200*b*, at an end portion 200*c* of the channel formation member 200*b*. The metal layer 136 may be formed by using the same material as the anti-cavitation layer 130 in the same step, for example. As illustrated in FIG. 4A, the metal layer 136 is electrically connected to the drain of the pMOS transistor 900.

A case is envisioned in which ESD occurs and the channel formation member 200*b* and the orifice formation member

200*a* are charged. As illustrated in FIG. 11, the anti-cavitation layer 130 and the channel formation member 200*b* and also the orifice formation member 200*a* are formed in contact. In such a case, the metal layer 136 has a role of releasing charge that has moved to the end portion 200*c* of the channel formation member 200*b* passing along the surface of the orifice formation member 200*a* and the channel formation member 200*b* to GND via the pMOS transistor 900.

By the configuration according to the present embodiment, it is possible to suppress insulation breakdown of the protection layer 142 which is an insulating layer as well as charge flowing to the electrical circuit formed in the print element substrates 301.

Note that the configuration of the present embodiment may be combined with the configurations discussed in the first to fourth embodiments.

Sixth Embodiment

Explanation is given below regarding a sixth embodiment according to the present application invention.

Figure 5A:
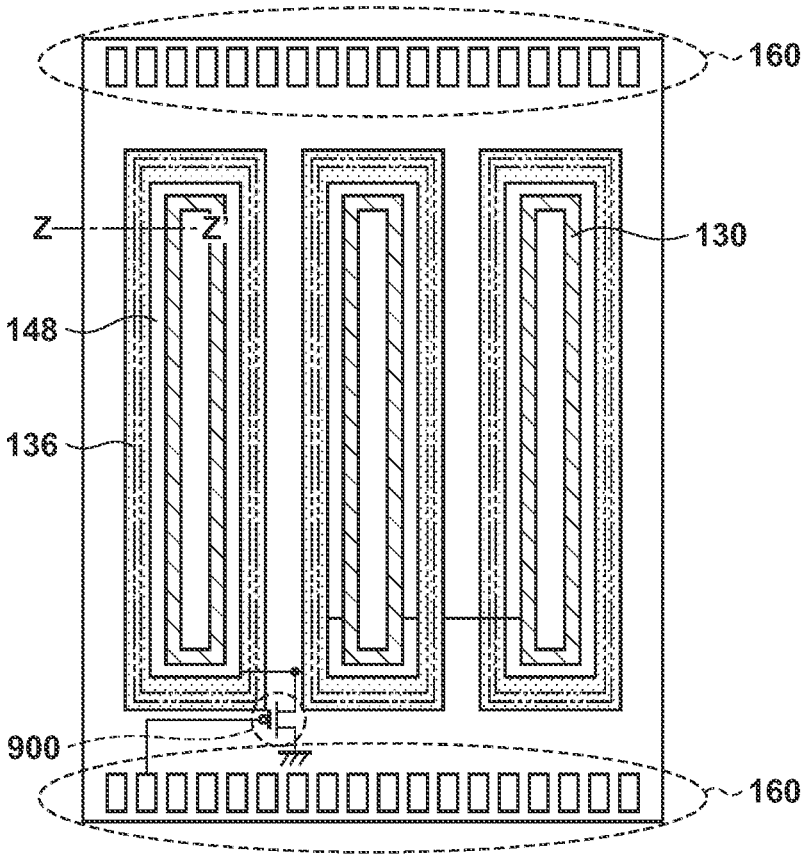
FIGS. 5A and 5B are views illustrating examples of configurations of the print element substrate according to a sixth embodiment.
Figure 5B:
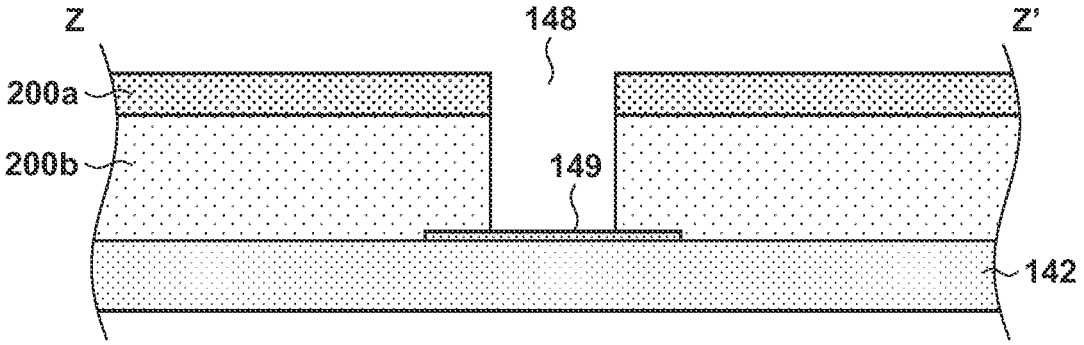

FIG. 5A illustrates a groove portion 148 that is formed in accordance with the removal of a portion of the channel formation member 200*b* to mitigate stress due to the channel formation member 200*b*. FIG. 5B is a view that illustrates a cross section of Z-Z' of FIG. 5A. A metal layer 149 is formed below the channel formation member 200*b*, in the groove portion 148 of the channel formation member 200*b*. The metal layer 149 may be formed by using the same material as the anti-cavitation layer 130 in the same step, for example. As illustrated in FIG. 5A, the metal layer 149 is electrically connected to the drain of the pMOS transistor 900.

A case is envisioned in which ESD occurs and the channel formation member 200*b* and the orifice formation member 200*a* are charged. In such a case, the metal layer 149 has a role of releasing charge that has moved to the groove portion 148 of the channel formation member 200*b* passing along the surface of the orifice formation member 200*a* and the channel formation member 200*b* to GND via the pMOS transistor 900.

By a configuration according to the present embodiment, it is possible to suppress insulation breakdown of the protection layer 142 which is an insulating layer, and charge flowing to the electrical circuit formed in the print element substrates 301.

Note that the configuration of the present embodiment may be combined with the configurations discussed in the first to fifth embodiments.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-204566, filed Oct. 18, 2016, which is hereby incorporated by reference herein in its entirety.

What is claimed is:

1. A print element substrate comprising:

a pad for receiving a predetermined logic signal;

a plurality of layers including:

a silicon layer;

a heater layer;

an insulating layer arranged on the heater layer; and an anti-cavitation layer arranged on the insulating layer that is for protecting the insulating layer; and a switch that has a control terminal that is electrically connected to the silicon layer via a register and to the pad and has a first terminal that is electrically connected to the anti-cavitation layer and a second terminal that is electrically connected to the silicon layer, the switch causing the anti-cavitation layer and the silicon layer to have an electrical disconnection when the pad receives the predetermined logic signal and causing the anti-cavitation layer and the silicon layer to have an electrical connection so as to release charge caused by electric-static discharge to the silicon layer when the pad does not receive the predetermined logic signal.

2. The print element substrate according to claim 1, wherein the switch includes a p-channel metal-oxide semiconductor (PMOS) transistor, a drain of the PMOS transistor and a source of the PMOS transistor are electrically disconnected when the pad receives the predetermined logic signal, the drain and the source are electrically connected when the pad does not receive the predetermined logic signal, the drain of the PMOS transistor corresponds to the first terminal, and the source of the PMOS transistor corresponds to the second terminal.

3. The print element substrate according to claim 2, wherein the anti-cavitation layer is formed so as to be separated into a plurality of regions, and the separated anti-cavitation layers are each connected to different PMOS transistors.

4. The print element substrate according to claim 2, wherein the anti-cavitation layer is formed so as to be separated into a plurality of regions, and the separated anti-cavitation layers are each connected to the same PMOS transistor.

5. The print element substrate according to claim 2, wherein a metal layer is formed between the insulating layer and a formation layer formed in contact with the anti-cavitation layer, and the metal layer is connected to the drain of the PMOS transistor.

6. The print element substrate according to claim 5, wherein a groove portion is formed in a portion of the formation layer, the metal layer is formed on the bottom of the groove portion, and the metal layer is connected to the drain of the PMOS transistor.

7. The print element substrate according to claim 5, wherein the formation layer is configured to form a channel formation member that forms a channel for ink, and an orifice formation member that forms an orifice for ink.

8. The print element substrate according to claim 2, wherein the print element substrate comprises a first wiring layer that is connected to the heater layer and is for causing the heater to generate heat, wherein a gate of the PMOS is set to the high-level state when performing an electrical connection inspection of the anti-cavitation layer and the first wiring layer, and wherein the gate of the PMOS transistor corresponds to the control terminal.

9. The print element substrate according to claim 2, wherein the predetermined logic signal is a high-level signal.

10. The print element substrate according to claim 2, wherein the print element substrate comprises a n-channel metal-oxide semiconductor (NMOS) transistor which is electrically connected to the heater layer.

11. The print element substrate according to claim 1, wherein the switch includes a p-channel metal-oxide semiconductor (PMOS) transistor, a drain of the PMOS transistor and a source of the PMOS transistor are electrically disconnected when causing the heater layer to generate heat, the drain of the PMOS transistor corresponds to the first terminal, and the source of the PMOS transistor corresponds to the second terminal.

12. The print element substrate according to claim 1, wherein the control terminal is pulled-down to ground by the resistor.

13. A printhead comprising:

a print element substrate comprising:

a pad for receiving a predetermined logic signal;

a plurality of layers including:

a silicon layer;

a heater layer;

an insulating layer arranged on the heater layer; and an anti-cavitation layer arranged on the insulating layer that is for protecting the insulating layer; and a switch that has a control terminal that is electrically connected to the silicon layer via a register and to the pad and has a first terminal that is electrically connected to the anti-cavitation layer and a second terminal that is electrically connected to the silicon layer, the switch causing the anti-cavitation layer and the silicon layer to have an electrical disconnection when the pad receives the predetermined logic signal and causing the anti-cavitation layer and the silicon layer to have an electrical connection so as to release charge caused by electric-static discharge to the silicon layer when the pad does not receive the predetermined logic signal.

14. The printhead according to claim 13, wherein the switch includes a p-channel metal-oxide semiconductor (PMOS) transistor, a drain of the PMOS transistor and a source of the PMOS transistor are electrically disconnected when the pad receives the predetermined logic signal, the drain and the source are electrically connected when the pad does not receive the predetermined logic signal, the drain of the PMOS transistor corresponds to the first terminal, and the source of the PMOS transistor corresponds to the second terminal.

15. The printhead according to claim 13, wherein the control terminal is pulled-down to ground by the resistor.

16. A printing apparatus comprising:

a print element substrate comprising:

a pad for receiving a predetermined logic signal;

a plurality of layers including:

a silicon layer;

a heater layer;

an insulating layer arranged on the heater layer; and an anti-cavitation layer arranged on the insulating layer that is for protecting the insulating layer; and a switch that has a control terminal that is electrically connected to the silicon layer via a register and to the pad and has a first terminal that is electrically connected to the anti-cavitation layer and a second terminal that is electrically connected to the silicon layer, the switch causing the anti-cavitation layer and the silicon layer to have an electrical disconnection when the pad receives the predetermined logic signal and causing the anti-cavitation layer and the silicon layer to have an electrical connection so as to release charge caused by electric-static discharge to the silicon layer when the pad does not receive the predetermined logic signal.

* * * * *